US008251245B2

(12) United States Patent
DiPietro et al.

(10) Patent No.: US 8,251,245 B2
(45) Date of Patent: Aug. 28, 2012

(54) CONTAINER WITH SEALING LID

(75) Inventors: Dean DiPietro, Brooklyn, NY (US); Timothy Jude Kennedy, Leonia, NJ (US); Sherwood Forlee, Brooklyn, NY (US); Eugene Ryu Kaneko, San Diego, CA (US)

(73) Assignee: Helen of Troy Limited, St. Michael (BB)

( * ) Notice: Subject to any disclaimer, the term of this patent is extended or adjusted under 35 U.S.C. 154(b) by 0 days.

(21) Appl. No.: 13/048,444

(22) Filed: Mar. 15, 2011

(65) Prior Publication Data

US 2011/0163099 A1 Jul. 7, 2011

Related U.S. Application Data

(63) Continuation-in-part of application No. 12/387,795, filed on May 7, 2009.

(60) Provisional application No. 61/128,407, filed on May 21, 2008.

(51) Int. Cl.
*B65D 45/16* (2006.01)
*B65D 51/18* (2006.01)
*B65D 45/00* (2006.01)

(52) U.S. Cl. ..... 220/324; 220/255; 220/315

(58) Field of Classification Search ..... 220/255, 220/256, 315, 319, 324, 326, 378, 780, 802
See application file for complete search history.

(56) References Cited

U.S. PATENT DOCUMENTS 2,535,840 A 4/1946 Coyle et al.
2,579,974 A * 12/1951 Scott et al. ..... 229/5.5
3,235,114 A * 2/1966 Blackwood et al. ..... 215/350
3,499,574 A * 3/1970 Yates, Jr. ..... 220/784
3,871,545 A * 3/1975 Bereziat ..... 215/249
3,904,074 A * 9/1975 Hoffman et al. ..... 220/258.3
3,930,589 A * 1/1976 Koontz ..... 215/352
4,094,460 A * 6/1978 Scanga et al. ..... 229/123.1
4,133,447 A * 1/1979 Bouchet ..... 220/258.3
4,305,535 A * 12/1981 Brundige et al. ..... 229/5.7
4,337,874 A 7/1982 Hoenig et al.
4,453,646 A * 6/1984 Harrild ..... 220/258.5
4,466,553 A * 8/1984 Zenger ..... 220/495.08
4,809,874 A 3/1989 Pehr
5,052,568 A * 10/1991 Simon ..... 215/250
5,127,523 A * 7/1992 Herdlicka ..... 206/370
5,163,576 A 11/1992 Galer
5,284,270 A * 2/1994 Kusta ..... 220/321
5,348,549 A * 9/1994 Brown et al. ..... 604/403

(Continued)

FOREIGN PATENT DOCUMENTS

NZ 519613 1/2004

(Continued)

OTHER PUBLICATIONS

New Zealand Examination Report, Patent Application No. 592153, 2 pages, Dated Apr. 14, 2011.

(Continued)

*Primary Examiner* — J. Gregory Pickett
*Assistant Examiner* — Kaushikkumar Desai

(57) ABSTRACT

A releasably sealable container is disclosed. The container includes a container body, a lid, a gasket and a retaining arm. The container body includes a lip defining an opening. The lid is configured to engage the opening. The lid includes a body and a frame. The gasket is configured to cooperate with the lid and the lip to seal the opening.

11 Claims, 12 Drawing Sheets

U.S. PATENT DOCUMENTS

| | | | | |
|---|---|---|---|---|
| 5,540,349 | A * | 7/1996 | Philips | 220/780 |
| 5,582,314 | A | 12/1996 | Quinn et al. | |
| 6,006,942 | A | 12/1999 | Morris, Sr. et al. | |
| 6,170,691 | B1 * | 1/2001 | Morris et al. | 220/304 |
| 6,253,947 | B1 | 7/2001 | Yang | |
| 6,619,498 | B2 | 9/2003 | von Holdt, Jr. | |
| 6,669,049 | B2 | 12/2003 | Crider | |
| 6,708,839 | B2 | 3/2004 | Diesterbeck | |
| 6,786,346 | B1 * | 9/2004 | Gurnard et al. | 215/272 |
| 6,789,692 | B2 | 9/2004 | Prezelin | |
| 6,793,096 | B1 * | 9/2004 | Seok | 220/788 |
| 6,834,772 | B1 | 12/2004 | Thoros | |
| 6,929,145 | B2 * | 8/2005 | Shepler | 220/788 |
| 7,080,754 | B2 | 7/2006 | Lown | |
| 2002/0053569 | A1 | 5/2002 | Mills et al. | |
| 2002/0148846 | A1 | 10/2002 | Luburic | |
| 2002/0148847 | A1 * | 10/2002 | Luburic | 220/795 |
| 2004/0084465 | A1 | 5/2004 | Luburic | |
| 2005/0269339 | A1 | 12/2005 | Ciccone | |
| 2006/0076352 | A1 | 4/2006 | Peterson et al. | |
| 2006/0261067 | A1 | 11/2006 | Letica | |
| 2007/0102438 | A1 | 5/2007 | Schwarz | |
| 2007/0205196 | A1 | 9/2007 | Burney et al. | |

FOREIGN PATENT DOCUMENTS

| | | |
|---|---|---|
| NZ | 547667 | 10/2007 |
| WO | WO 2007/148916 | 12/2007 |

OTHER PUBLICATIONS

New Zealand Examination Report, Patent Application No. 583387, 3 pages, Dated Apr. 14, 2011.

P.R. China Notification of First Office Action, Application No. 200980100111.7, 8 pages, Dated Mar. 29, 2011.

* cited by examiner 74
72
52
74
68
70
74b
34
64
74
74
54a
62
74a
54
50
54a
36
40
42
48
32

CONTAINER WITH SEALING LID

CROSS-REFERENCE TO RELATED APPLICATIONS

This application claims priority to U.S. patent application Ser. No. 12/387,795, filed May 7, 2009, of which this application is a Continuation In Part therefrom and which claims priority to U.S. Provisional Patent Application Ser. No. 61/128,407, filed May 21, 2008.

FIELD OF THE INVENTION

This invention relates generally to containers, and in more particular applications to containers with sealing lids, such as for food and the like.

BACKGROUND

Containers are known for storing a wide variety of items such as miscellaneous hardware, school supplies, toys and the like. Additionally containers are used for storing food, including dry food, wet food and even liquids. However, it is oftentimes desired to keep dry foods dry and keep wet or moist foods wet. Furthermore, it is oftentimes desired to prevent liquids from leaking into or out of the container while in storage.

For such applications, it is known to use containers having gaskets and other forms of seals to keep liquids and moisture in the container. However, the gaskets and seals in such containers may not always seal correctly and may develop localized areas where liquid can enter and/or escape from the container.

Furthermore, it can be difficult to determine if a lid has completely sealed around the entire opening of the container. This can be especially problematic with wet foods as liquid can escape from the container if the lid is not sealed properly and/or evenly. For example, if the lid is not sealed evenly, a slight bumping or jarring of the lid or container may cause the lid to separate sufficiently separate and permit liquid to escape.

SUMMARY

In one form, a releasably sealable container is provided. The container includes a container body, lid, a gasket and a locking arm. The container body includes a lip defining an opening. The lid is configured to engage the opening. The lid includes a body and a frame. The gasket is configured to cooperate with the lid and the lip to substantially seal the opening. The locking arm is coupled to the body and configured to move between an engaging position to releasably couple the lid to the container body and a disengaging position permitting the lid to be removed from the container body. The body cooperates with the locking arm to move the locking arm from the disengaging position to the engaging position.

According to one form, a releasably sealable container is provided. The container includes a container body, lid, a gasket and a locking arm. The container body includes a lip defining an opening. The lip includes a sealing portion and an engaging portion. The lid is configured to engage the opening. The lid includes a body and a frame. The gasket is configured to cooperate with the lid and the sealing portion of the lip to substantially seal the opening. The locking arm is coupled to the body. The body is configured such that movement of the lid in a direction towards the container body causes the locking arm to move inwardly and engage the engaging portion, and movement of the lid in direction away from the container body permits the locking arm to move outwardly and disengage the engagement portion.

In accordance with one form, the container further includes a plurality of locking arms.

In one form, the container further includes at least one release handle located on the frame.

According to one form, the locking arm includes a flexible hinge connecting the locking arm to the body to permit the locking arm to pivot relative to the body.

In accordance with one form, the container further includes a retaining arm coupled to the body to contact at least one of the locking arm or the lip to retain the lid on the container body.

In one form, the lip includes a sealing portion and an engaging portion, and the locking arm includes a cammed portion, the cammed portion contacting the engaging portion when in the engaging position.

According to one form, the locking arm includes a hook-shaped portion and a disengagement portion, and the frame including a pulling arm, the pulling arm cooperating with the disengagement portion to move the locking arm to the disengaging position.

According to another form, a releasably sealable container is provided. The container includes a container body, lid, gasket, and retaining arm. The container body includes a lip defining an opening. The lip includes a sealing portion and an engaging portion. The lid is configured to engage the opening. The lid includes a body and a frame. The gasket is configured to cooperate with the lid and the sealing portion of the lip to substantially seal the opening. The frame includes a release handle and the retaining arm is disposed on the frame adjacent thereto. The lid is configured such that movement of the lid in a direction towards the lip of the container body causes the retaining arm to move to an engaged position, wherein the retaining arm engages the engaging portion of the lip, thereby releasably coupling the lid to the container body. The release handle is adapted to move the retaining arm to a disengaged position, wherein the retaining arm sufficiently disengages the engaging portion of the lid to permit decoupling of the lid from the container body.

In accordance with one form, a method of sealing a container is provided. The method includes the steps of: providing a container body having a lip defining an opening, the lip including a sealing portion and an engaging portion; providing a lid configured to engage the opening, the lid comprising a body, a frame and a locking arm; positioning a gasket between the lid and the sealing portion of the lip; and moving the lid in a direction towards the container body causing the locking arm to move inwardly and engage the engaging portion.

In one form, the step of moving the lid in a direction towards the container body causing the locking arm to move inwardly includes causing a cammed portion of the locking arm to engage the engaging portion.

According to one form, the step of moving the lid in a direction towards the container body causing the locking arm to move inwardly includes causing a hook-shaped portion of the locking arm to engage the engaging portion.

In accordance with one form, the method includes the further step of moving the lid in an upward direction permitting the locking arm to move outwardly and disengage from the engaging portion.

In accordance with another form, a method of sealing a container is provided. The method includes the steps of: providing a container body having a lip defining an opening, the lip including a sealing portion and an engaging portion; providing a lid configured to engage the opening, the lid comprising a body and a frame, wherein the frame includes a release handle operably coupled to a retaining arm adjacent thereto; positioning a gasket between the lid and the sealing portion of the lip; and moving the lid in a direction towards the container body causing the retaining arm to move inwardly and engage the engaging portion.

In accordance with one form, the method includes the further step of moving the release handle to cause the retaining arm to disengage the engaging portion to permit removal of the lid from the container body.

Other forms are also contemplated as understood by those skilled in the art.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its constructions and operation, and many of its advantages should be readily understood and appreciated.

Figure 1:
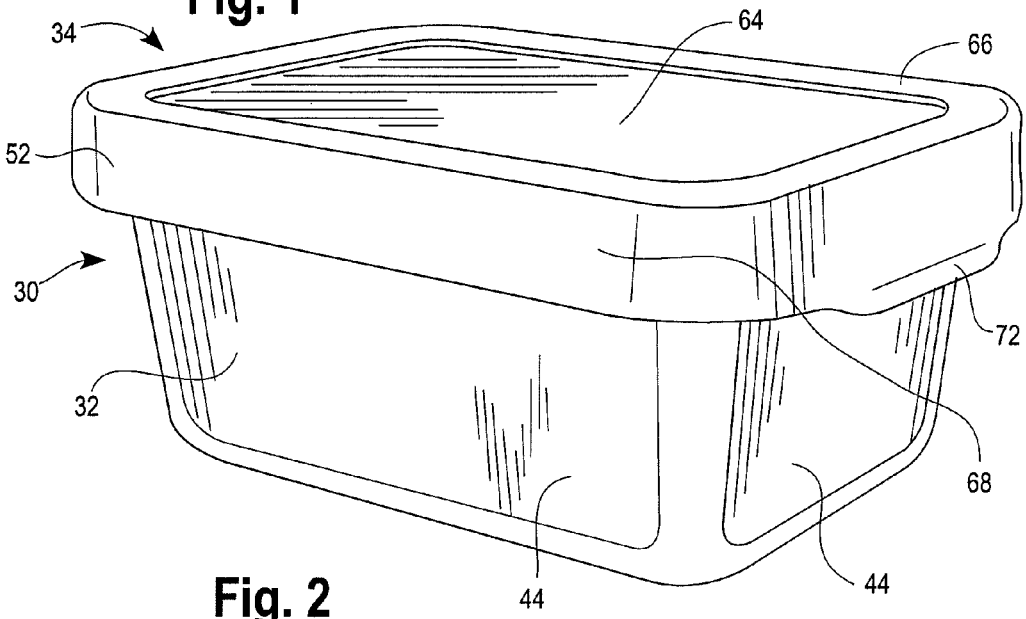
FIG. 1 is a perspective view of one form of a container of the present invention.

Various figures are presented to further aid one skilled in the art in understanding the various forms of the multi-tiered shelf system. However, the present invention should not be construed to be limited to the forms depicted in the figures and described herein.

DETAILED DESCRIPTION

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Figure 2:
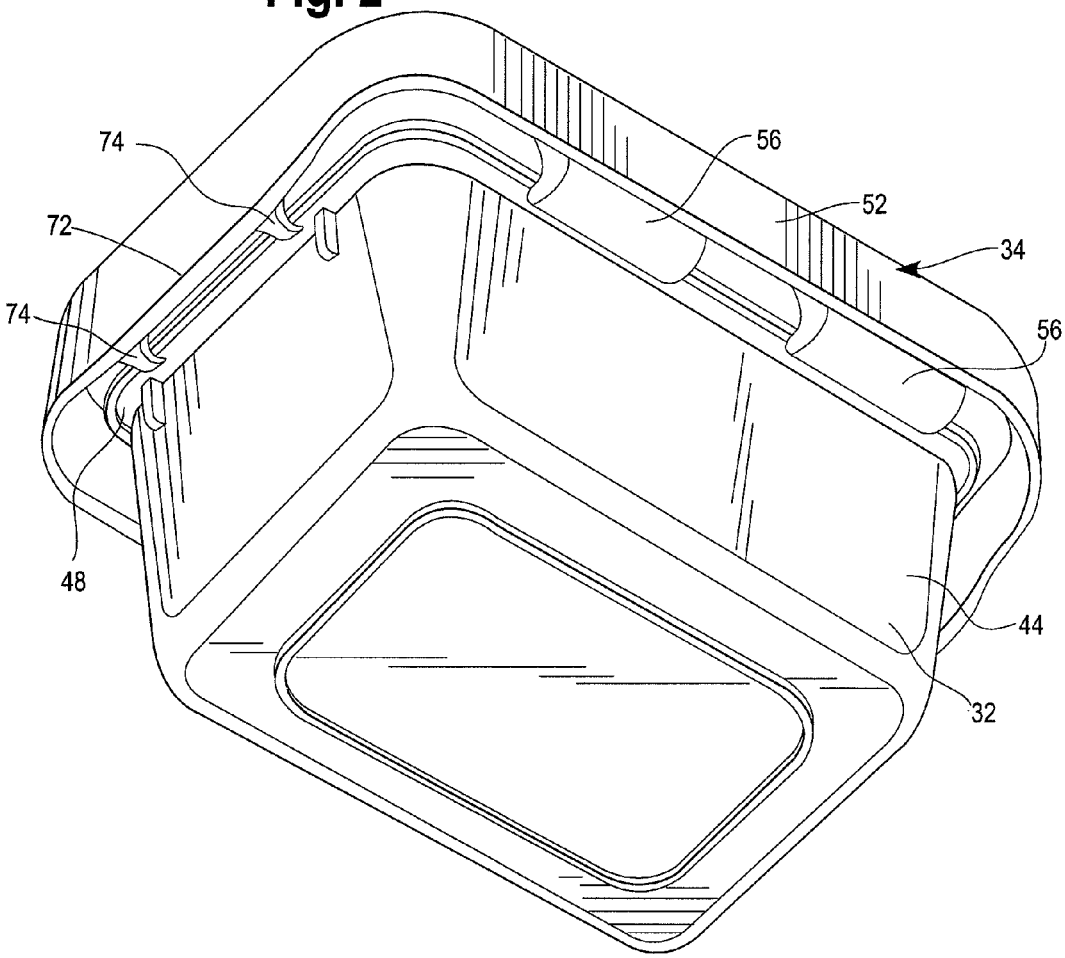
FIG. 2 is a bottom perspective view of the container of FIG. 1.
Figure 3:
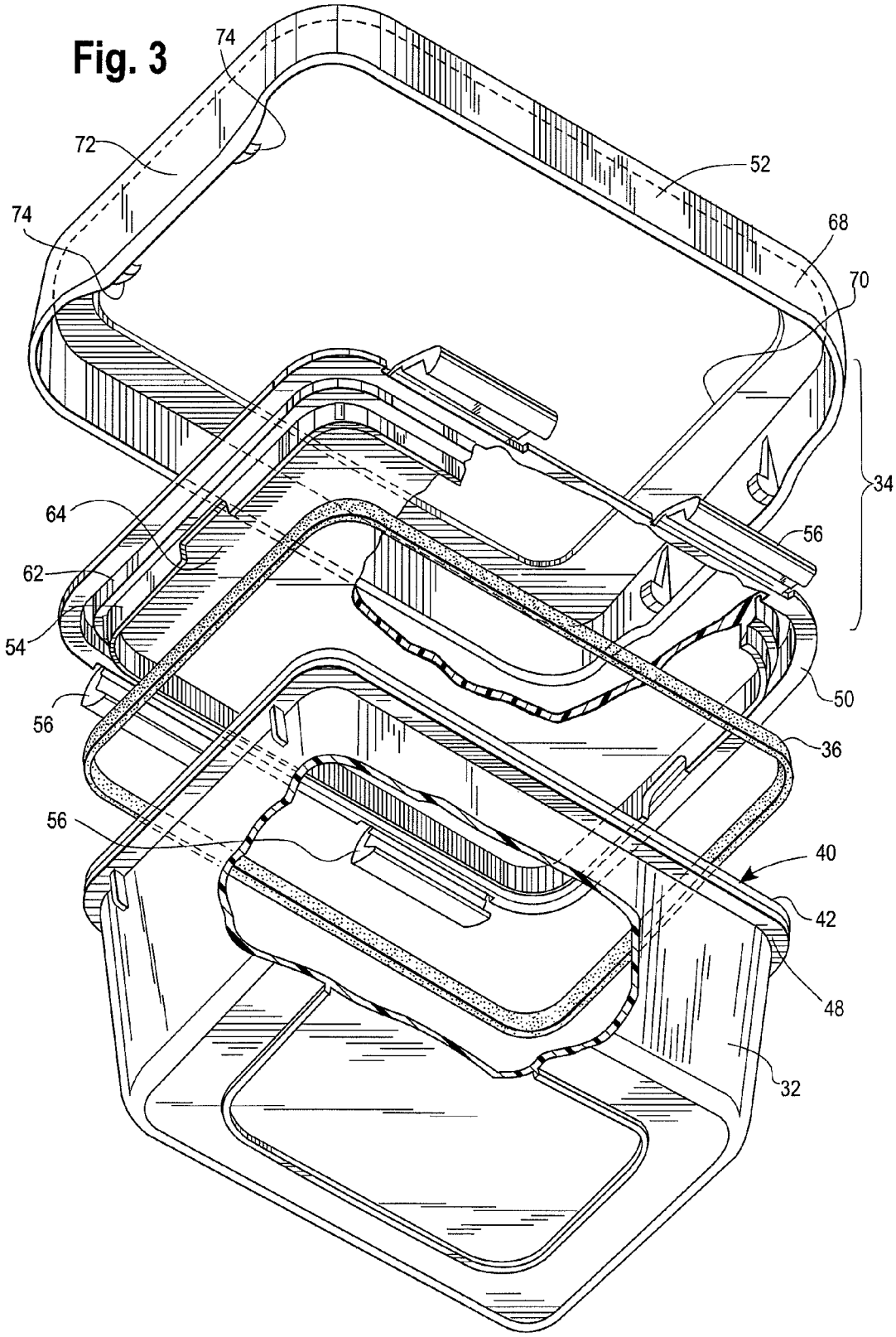
FIG. 3 is a partial cut away, exploded view of one form of a container of the present invention.

Referring to FIGS. 1-4D, one form of a container 30 of the present invention is shown. The container 30 includes a container body 32 and a lid 34. As best seen in FIG. 3, the container body 32 also includes a gasket 36 and a locking arm 56. The container body 32 may also include other features and structures as will be discussed below as well as other features and structures understood by those skilled in the art.

The container body 32 generally includes an opening 40 defined by a lip 42 and at least one wall 44. The size and shape of the opening 40, as well as the size and shape of the container body 32 can vary in accordance with the size and shape of the wall(s) 44, as understood by those skilled in the art. For example, as shown in FIGS. 1-2, the container body 32 is generally rectangular having five walls (four side walls and a bottom wall). However, it should be understood that the container body can be square, round and the like and may also be configured in any desired size.

The lip 42 can include a sealing portion 46 and an engaging portion 48. Referring to FIGS. 4A-D, in one form, the sealing portion 46 is located towards the top of the lip 42 and is positioned outwardly from the container body 32 while the engaging portion 48 is located towards an opposite portion of the lip 42. As shown in this form, the engaging portion 48 and the sealing portion 46 each include generally flat surfaces. However, as described below regarding other embodiments, these portions can include other shapes and surfaces, such as rounded surfaces and the like.

In one form, the lid 34 generally includes a body 50 and a frame 52. The body 50 and frame 52 can be included as a single integral unit or may be two separable units, as shown in FIG. 3. Generally, the frame 52 is positioned around and cooperates with the body 50 to substantially seal the container body 32, as will be discussed in more detail below.

In one form, the body 50 includes a skirt 54 which can be used to help align the body 50 as it is positioned on the container body 32. For example, the skirt 54 can be sized and positioned on the body 50 to fit just inside the opening 40 when the body 50 is properly aligned. The body 50 can also include one or more locking arms 56. As shown in FIG. 3, in one form, the system 30 includes four locking arms 56. It should be understood that greater or fewer locking arms 56 can be utilized as desired. Furthermore, in FIG. 3, there are locking arms 56 on only two sides of the body 50. It should be noted that the locking arms 56 can be located on greater or fewer than two sides of the body 50 and need not be located on opposite sides.

The locking arms 56 are movable and can be used to help seal the lid 34 to the container body 32. In one form, as illustrated in FIGS. 4A-D, the locking arms 56 include a cammed portion 58 and a living hinge or film hinge 60. The locking arms 56 can also take other shapes and forms as will be discussed herein regarding other embodiments and as understood by those skilled in the art.

The body 50 can also include a gasket channel 62 for receiving a portion of the gasket 36. In an embodiment, the gasket 36 is constructed of an elastomeric material. It should be noted that the gasket channel 62 can be configured to permanently retain, such as, for example, a friction fit or adhesive, or releasably retain the gasket 36. The body 50 also includes a cover portion 64 that generally covers the opening 40. In one form, the cover portion 64 is transparent so that a user can view the interior of the container body 32. It will be appreciated that the cover portion 64 can also be translucent or opaque, and may further include a location to facilitate writing or label placement to identify the contents or the like.

The frame 52 generally includes a top portion 66 and a side portion 68. In one form, as best seen in FIG. 3, the top portion 66 defines an opening 70 whereby the body 50 can be viewed when installed. In one embodiment, the frame 52 also includes one or more grips or release handles 72 that can be used to help manipulate the frame 52 when in use. Furthermore, the frame 52 can include one or more retaining arms 74. The retaining arms 74 can be used to help maintain the frame 52 on the container body 32. In one form, the frame 52 includes two release handles 72 on opposite sides of the frame 52 and includes two retaining arms 74 located adjacent each release handle 72. In this form, the release handles 72 can be used to help manipulate the retaining arms 74. For example, the frame 52 can be constructed of a resilient plastic that allows moderate deformation and subsequent movement of the retaining arms 74. The retaining arms 74 can be used to contact the body 50, the locking arms 56, the container body 32, the lip 42 or other structure to retain the lid 34 on the container body 32. It should be understood that the frame 52 can include any number of release handles 72 and retaining arms 74 and further that these structures can be located in any number of different locations on the frame 52. Furthermore, it should be noted that while the retaining arms 74 are preferably located adjacent to the release handles 72, the retaining arms 74 can be located elsewhere and can even be included without the use of release handles 72. Moreover, in other forms, neither the release handles 72 nor the retaining arms 74 need to be included.

Figure 4A:
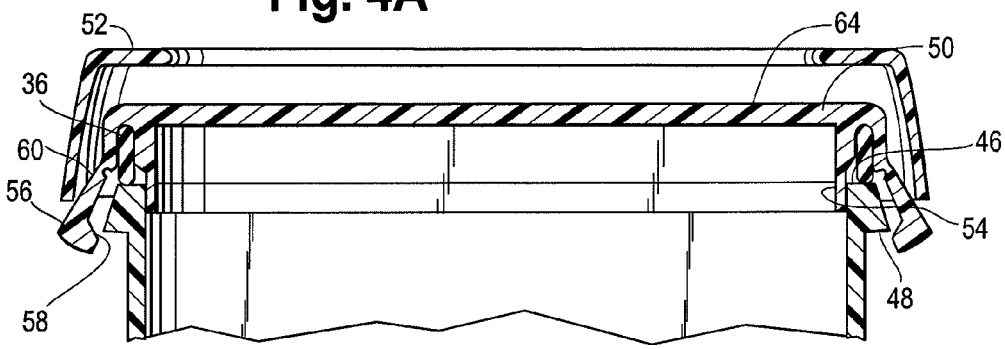
FIG. 4A is a cross-sectional view of a portion of a container of the present invention in a disengaged position.

The frame 52 can take any number of different sizes, shapes and orientations as understood by those skilled in the art. For example, as illustrated in FIGS. 1-4D, the frame 52 is generally rectangular. Furthermore, as best seen in FIG. 4A, in one form, the side portion 68 extends somewhat outwardly and away from the container body 32. In this regard, the shape of the side portion 68 can be used to help cooperate with the body 50 and the locking arms 56.

The gasket 36 can be any conventional gasket as understood by those skilled in the art. As discussed above, the gasket 36 is generally positioned between the lid 34 and the container body 32. Furthermore, in one form, the gasket 36 is positioned between the body 50 and the lip 42. In this regard, the gasket 36 can be releasably secured to the body 50 such as by being located in the groove 62. Alternatively, the gasket 36 can be located in other regions and coupled, releasably or otherwise, to other structures. For example, the gasket 36 could form a portion of the container body 32 and/or the lip 42 or be a separate component from the lid 34 and the container body 32. Other locations and methods of securing the gasket 36 are also contemplated as understood by those skilled in the art.

Figure 4B:
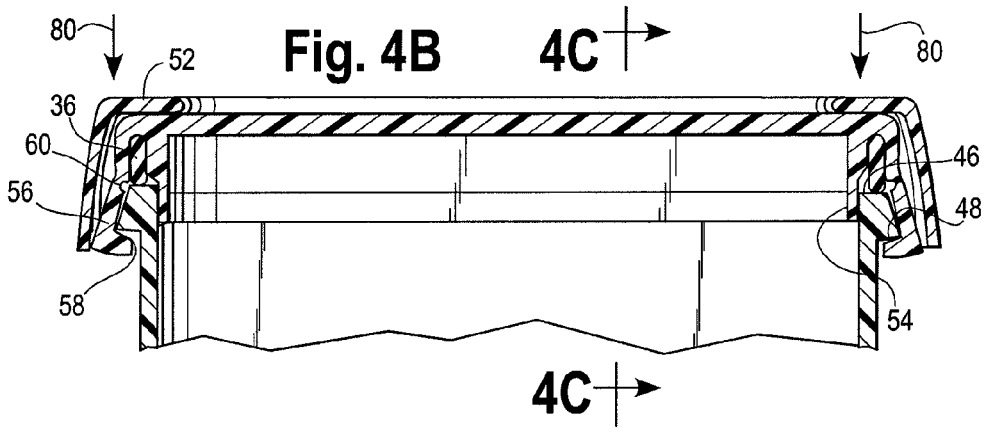
FIG. 4B is a cross-sectional view of a portion of a container of the present invention moving from the disengaged position to an engaged position.

The operation of the structures illustrated in FIGS. 1-4D will now be discussed in more detail. Referring to FIG. 4A, to seal the system 30, the frame 52 is positioned about the body 50 and the body 50 is positioned on the container body 32 with the gasket 36 between the lid 34 and the container body 32. The skirt 54 is utilized to help position the body 50 to cover the opening 40. Once positioned, the frame 52 is pushed towards the container body 32 generally in a direction indicated by arrows 80, as shown in FIG. 4B. The frame 52 contacts the body 50, and more particularly, the locking arms 56 to move the locking arms 56 inwardly towards the container body 32. In one form, as shown in FIG. 4B, the film hinge 60 helps the locking arms 56 move. In this form, the locking arms 56 substantially pivot about the location of the film hinge 60.

As the frame 52 is pushed towards the container body 32, the locking arms 56 engage the lip 42. In the form illustrated in FIG. 4A-D, the cammed surface 58 begins to contact the engaging portion 46. The engagement of the locking arms 56 with the lip 42 compresses the gasket 36 between the lid 34 and the container body 32.

Once the frame 52 has been displaced on the container body 32 sufficiently, the retaining arms 74 engage the lip 42 to retain the lid 34 on the container body 32 in the engaging position. As best seen in FIG. 2, in the engaging position, the locking arms 56 have engaged the lip 42 and are maintained in contact with the lip 42 by the side portion 68 of the frame 52 while the retaining arms 74 maintain the lid 34 on the container body 32. Once in the engaging position, the gasket 36 maintains a substantially air tight and/or liquid tight seal on the container body 32.

Figure 4C:
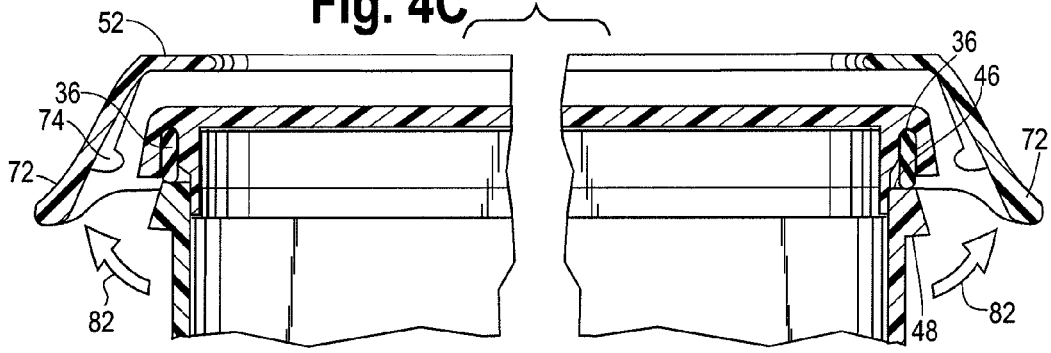
FIG. 4C is a cross-sectional view of a portion of a container of the present invention taken along line 4C-4C of FIG. 4B as moving from the engaged position to the disengaged position.
Figure 4D:
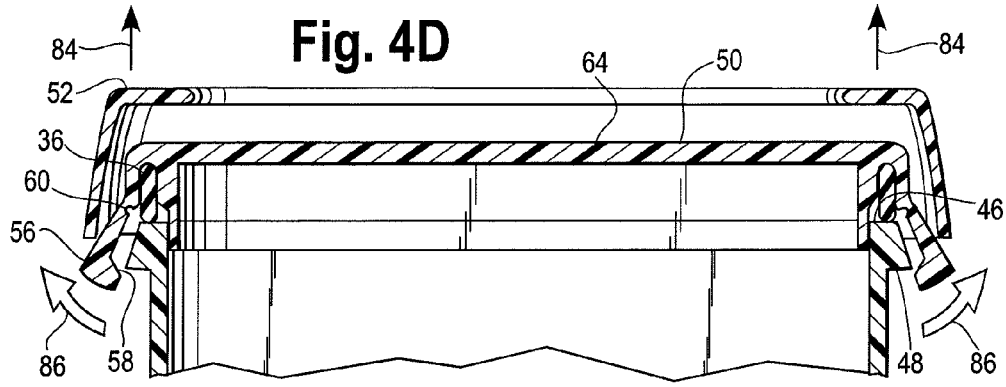
FIG. 4D is a cross-sectional view of a portion of a container of the present invention moving from the engaged position to the disengaged position.

The lid 34 can be removed from the container body 32 to permit access to the interior of the container body 32. FIG. 4C illustrates a cross-sectional view of the present invention, but the container body 32 has been rotated 90 degrees compared to FIG. 4B to illustrate the release handles 72 and retaining arms 74. Specifically, to remove the lid 34, one or more of the release handles 72 is pulled outwardly or otherwise resiliently deformed, away from the container body 32, such as illustrated by arrows 82. In this regard, the release handles 72 pull the retaining arms 74 away from the container body 32 and/or locking arms 56 to a sufficiently disengaged position to allow disengagement of the retaining arms 74 from the lip 42. Once the retaining arms 74 have been disengaged from the lip 42, the lid 34 can either be pulled away from the container body 32 or the gasket 36 and/or body 50 can push the lid 34 away from the container body 32, as illustrated by arrows 84 in FIG. 4D.

As the frame 52 is displaced away from the container body 32, the body 50 and gasket 36 are permitted to also extend upwardly and decompress. As the body 50 moves upwardly, the locking arms 56 are permitted to move outwardly away from the container body 32, as illustrated by arrows 86. The shape of the cammed surface 58 can help the locking arms 56 slide out from engaging the lip 42. Once the locking arms 56 disengage from the container body 32, the lid 34, including the body 50 and frame 52, can be removed from the container body 32.

Figure 5:
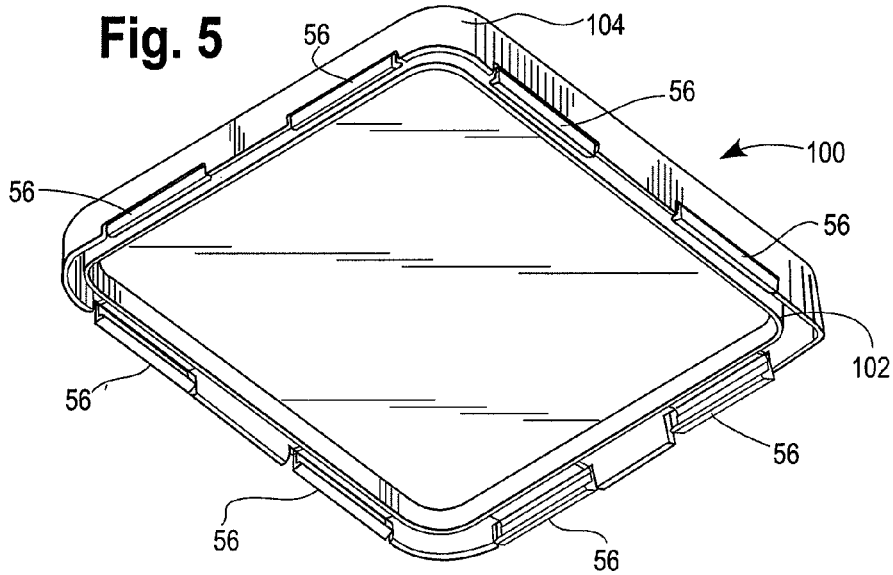
FIG. 5 is a bottom perspective view of one form of a lid body of the present invention.

Other forms of the present invention will now be discussed in more detail with the understanding that structures similar to those discussed above will not be discussed in detail for these alternative embodiments for the sake of brevity. One alternative form of a lid is shown in FIG. 5. As seen in FIG. 5, a body 100 is illustrated as having eight locking arms 56. In one form, these locking arms 56 are substantially the same as described with respect to FIGS. 1-4D. However, in this form, there are two locking arms 56 per side of the body 100. In certain circumstances, it may be preferable to include multiple locking arms 56 per side, especially when the sides and/or containers are large, to provide sufficient clamping force to maintain the seal. Furthermore, the body 100 includes an inner skirt 102 for helping align the body 100 on a container body and an outer skirt 104 for helping align and guide the frame (not shown) on the body.

Figure 6:
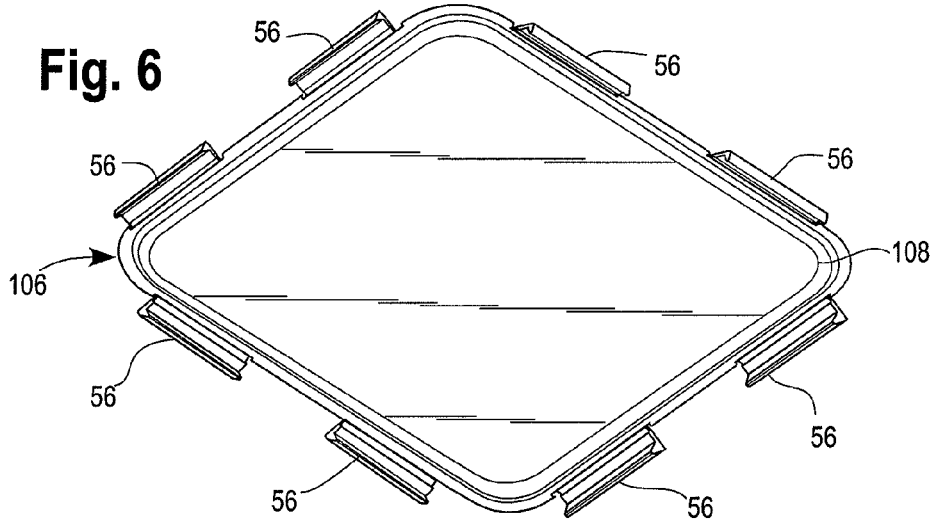
FIG. 6 is a bottom perspective view of one form of a lid body of the present invention.

Another form of a body 106 is illustrated in FIG. 6. This form is similar to the body 100 illustrated in FIG. 5 as there are eight locking arms 56, with two per side. However, this body 106 does not have an outer skirt 104 and includes a smaller inner skirt 108 compared to the body 100 in FIG. 5.

Figure 7:
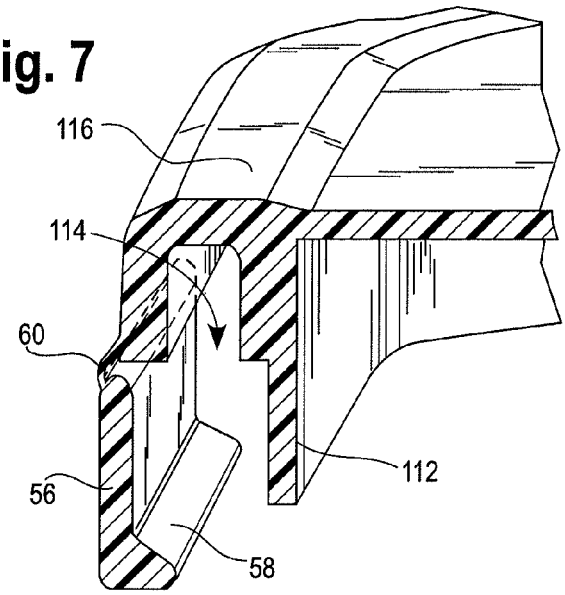
FIG. 7 is a cross-sectional view of a portion of a lid body of the present invention.

FIG. 7 illustrates an enlarged view of yet another body 110 having locking arm 56. This body 110 includes the locking arm 56 including the cammed surface 58 and film hinge 60. The body 110 also includes an inner skirt 112, a gasket channel 114 and a raised frame engaging portion 116. The raised frame engaging portion 116 may be utilized in some embodiments to provide a more defined portion for the frame to engage and help provide a clamping force to secure the lid to the container body. As illustrated in FIG. 7, the raised frame engaging portion 116 is located substantially adjacent the gasket channel 114 to help ensure that the maximum clamping force is provided to the gasket (not shown).

Figure 8:
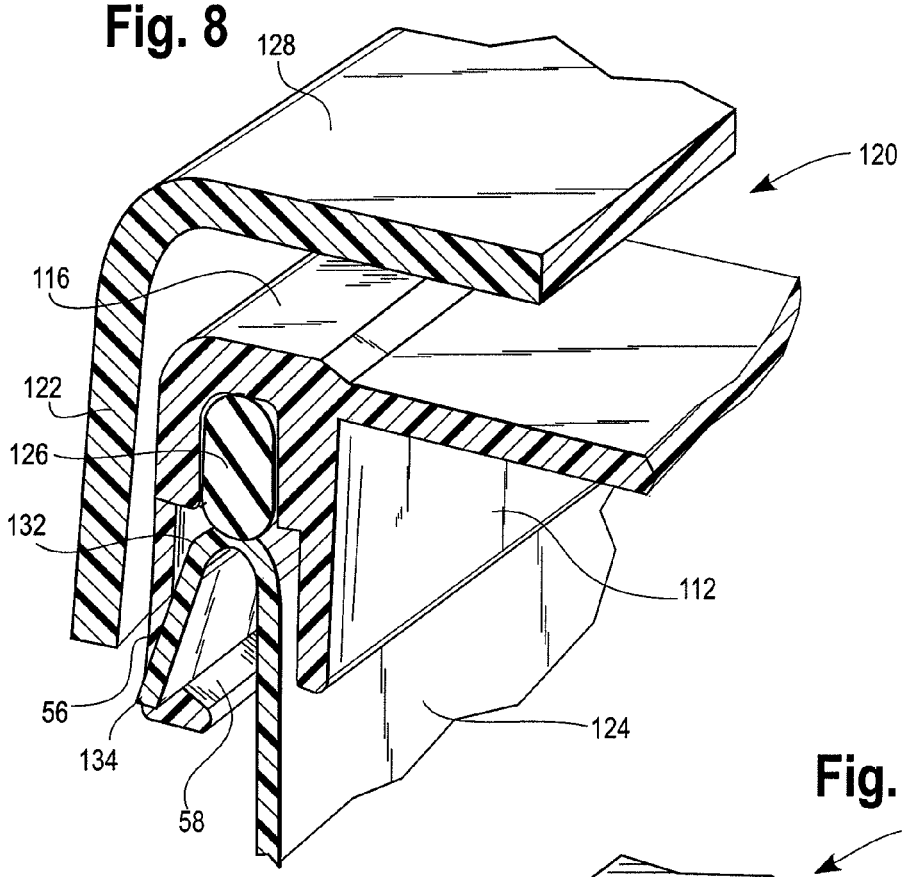
FIG. 8 is a cross-sectional view of a portion of a lid frame, lid body, gasket and container body lip of the present invention in an engaged position.
Figure 9:
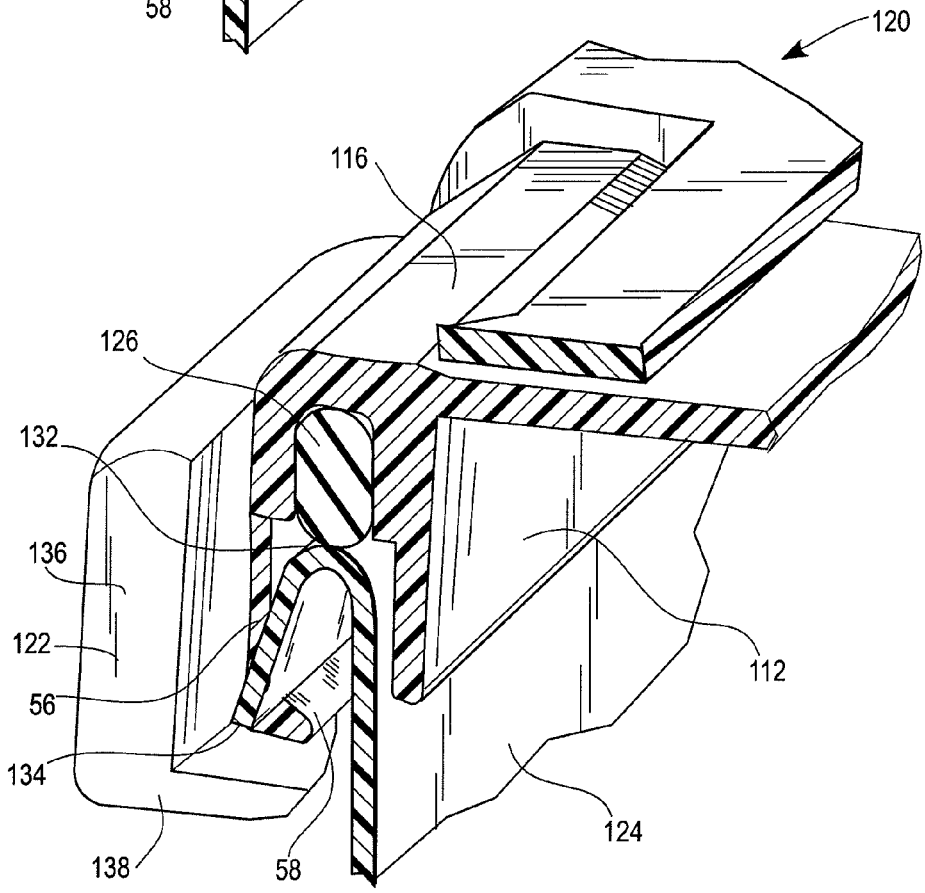
FIG. 9 is a cross-sectional view of a portion of a different form of a lid frame, lid body, gasket and container body lip of the present invention in an engaged position.
Figure 10:
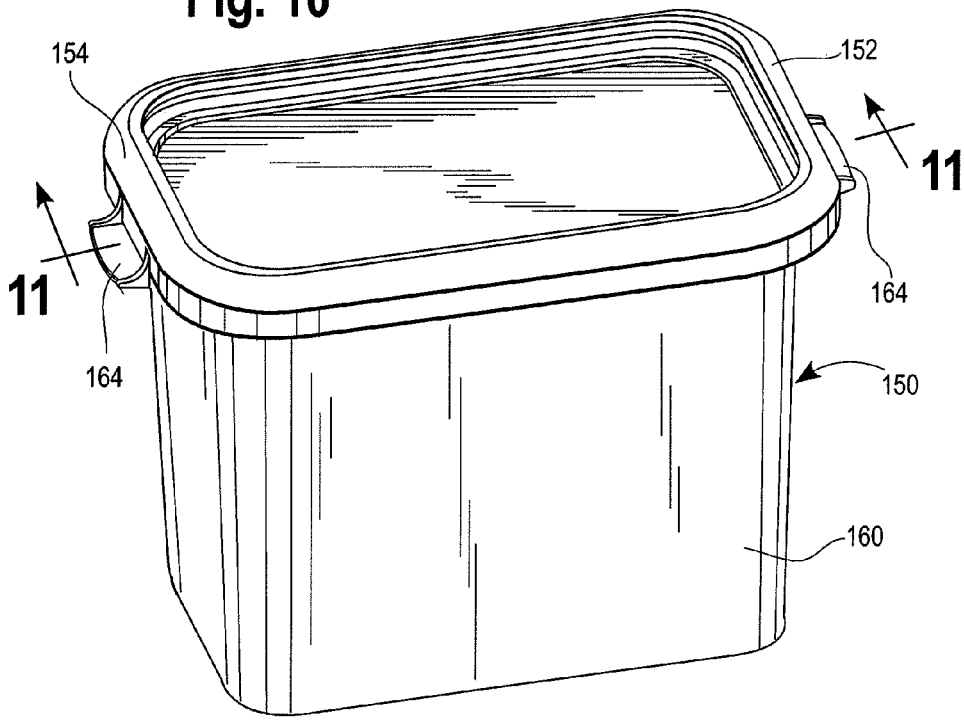
FIG. 10 is a perspective view of a further form of a container of the present invention.

FIGS. 8 and 9 illustrate one form of a container 120 utilizing the body 110 of FIG. 7. As seen in FIG. 8, the container 120 includes the body 110, a frame 122, a container body 124 and a gasket 126. The frame 122 includes a top portion 128 that is used to help contact the frame engaging portion 116. The container body 124 includes a rolled lip 130, having a rounded sealing portion 132 and an engaging portion 134.

FIG. 9 also illustrates the container 120, but focuses instead on a release handle 136. The release handle 136 includes a retaining arm 138 which can be used to engage at least one of the locking arm 56 and the container body 124. Just as discussed with respect to the forms shown in FIGS. 1-4D, the release handle 136 can be pulled outwardly and away from the container body 124 to disengage the retaining arm 138 and remove the frame 122 from the container body 124. In this regard, the frame 122 can include one or more open portions 140 adjacent one or more of the release handle 136 to permit the release handle 136 to resiliently flex inwardly and outwardly from the container body 124 to move the retaining arms 138 from the engaged position (wherein the retaining arms 138 engage the container body 124 to releasably couple the frame 122 and lid to the container body 124) and disengaged position (wherein the retaining arms 138 sufficiently disengage the container body 124 so that the frame 122 and lid can be removed from the container body 124).

Figure 11:
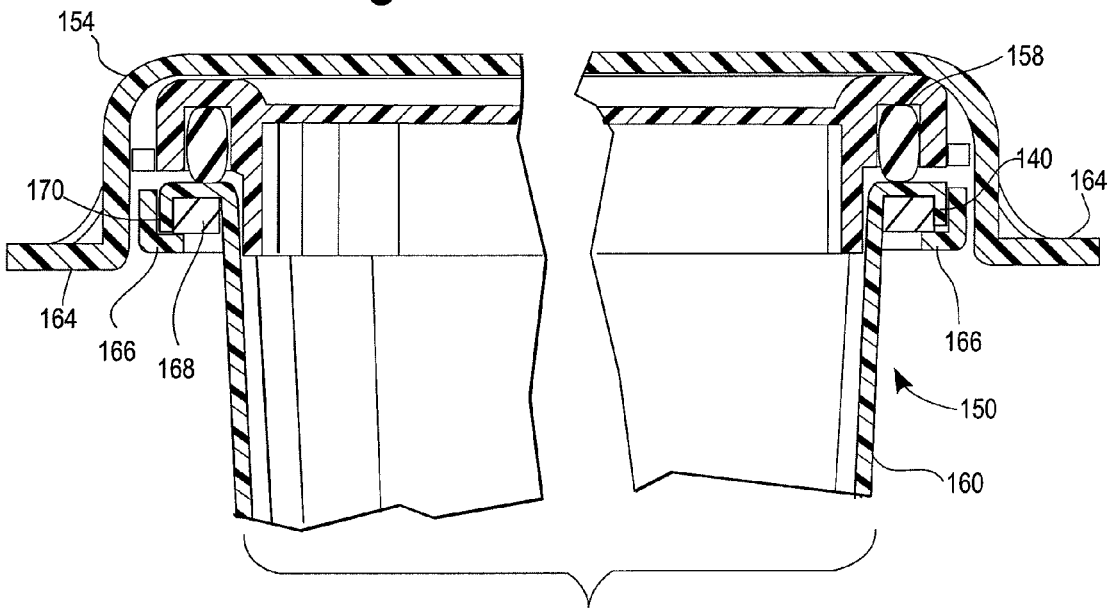
FIG. 11 is a cross-sectional view taken along line 11-11 of FIG. 10.
Figure 12:
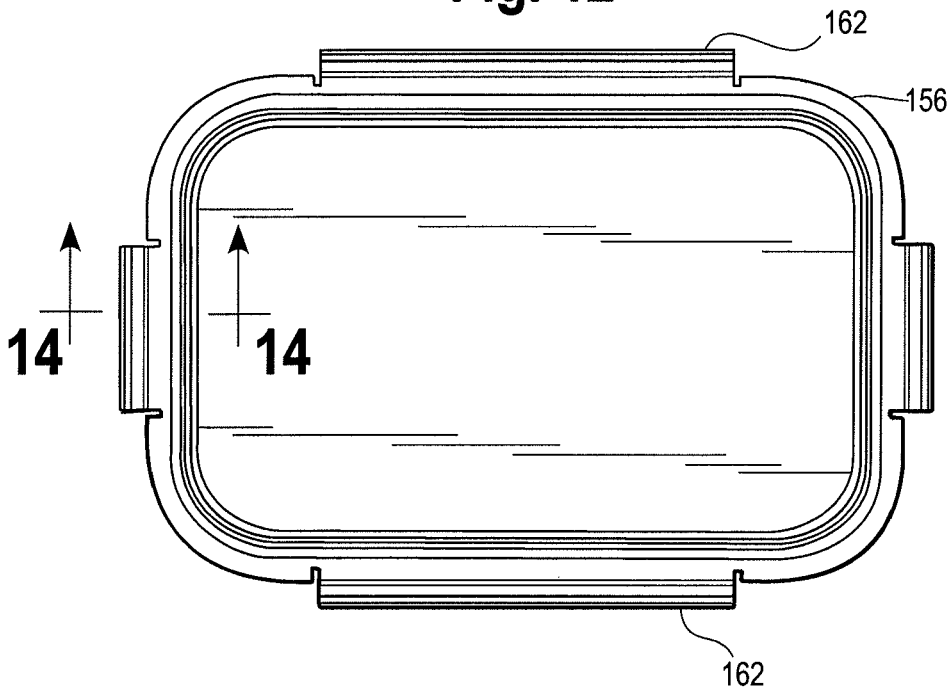
FIG. 12 is a bottom plan view of a further form of a lid body of the present invention.
Figure 13:
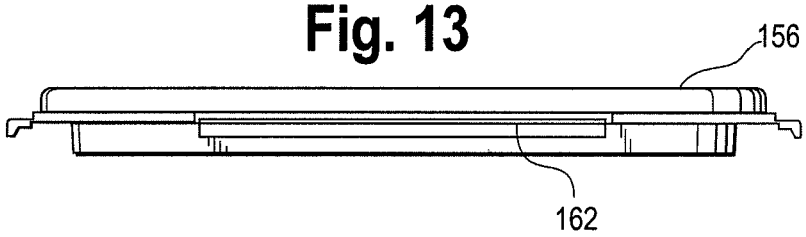
FIG. 13 is a side view of the lid body of FIG. 12.
Figure 14:
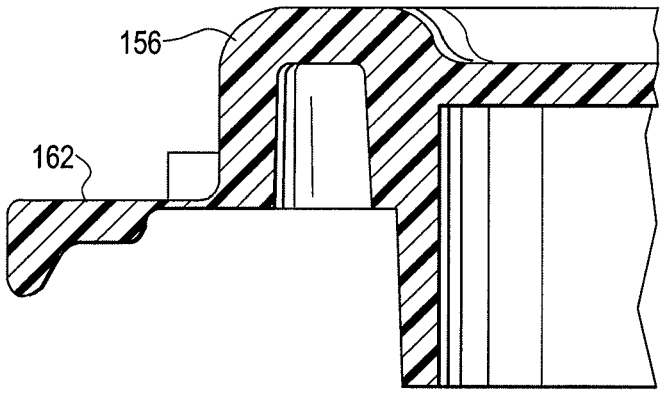
FIG. 14 is a cross-sectional view taken along line 14-14 of FIG. 12.
Figure 15:
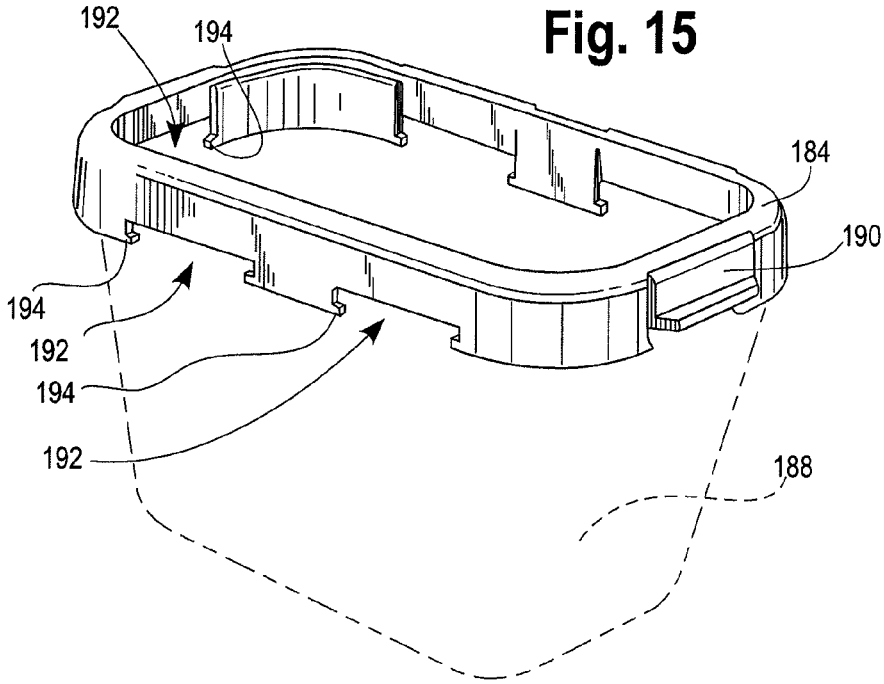
FIG. 15 is a perspective view of a further form of a lid frame with a container of the present invention shown in phantom.
Figure 16:
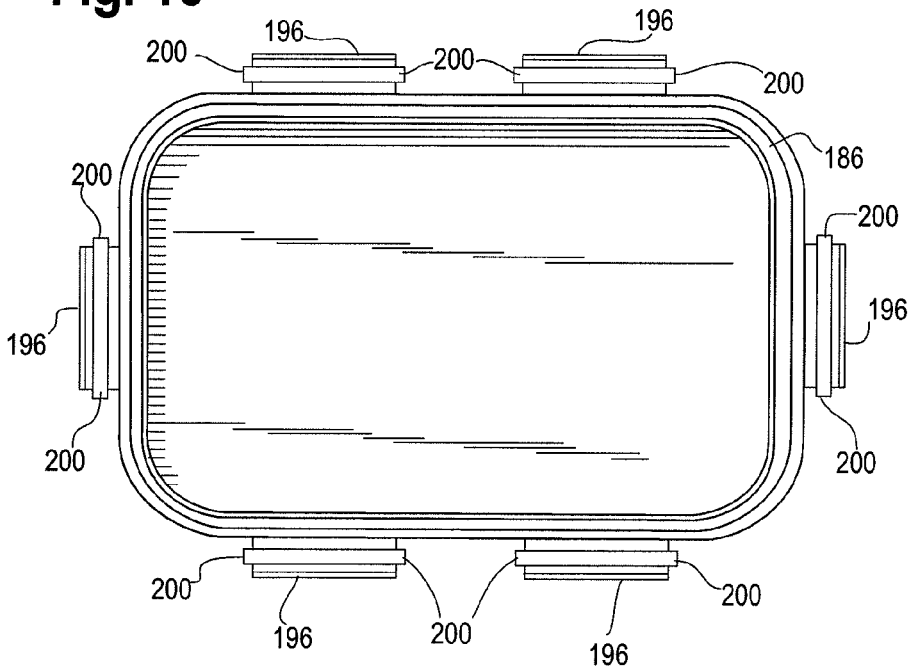
FIG. 16 is a bottom plan view of a further form of a lid body of the present invention.
Figure 17:
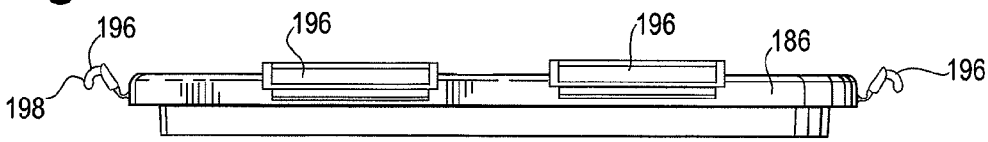
FIG. 17 is a side view of the lid body of FIG. 16.

Yet another form of a container 150 is illustrated in FIGS. 10-14. The container 150 includes a lid 152 including a frame 154 and a body 156. The container 150 also includes a gasket 158 and a container body 160. As best seen in FIG. 12, the body 156 includes two large locking arms 162 on opposing sides of the body 156. The frame 154 includes release handles 164 in the form of handles. Furthermore, the frame 154 includes retaining arms 166 adjacent the handles 164. As best seen in FIG. 11, the retaining arms 166 engage an insert 168 located on the container body 160. The insert 168 can be positioned such that it extends slightly beyond the lip 170 so that the lip 170 is not contacted or worn down by the retaining arms 166 or the locking arms 162 during use. In one form, the insert 168 is made of a low friction material to minimize wear and resistance. However, it should be understood that the insert 168 can be made from any material as understood by those skilled in the art.

Yet another form of a container 180 is illustrated in FIGS. 15-21. The container 180 includes a lid 182 having a frame 184 and a body 186, a gasket 187 and a container body 188. The frame 184 includes release handles 190 and a plurality of apertures 192 having at least one pulling arm 194. The body 186 includes a plurality of locking arms 196, with each of the locking arms 196 including a hook-shaped portion 198 and at least one disengagement portion 200. The disengagement portions 200 are located and configured to cooperate with the pulling arms 194. The container body 188 includes a lip 202 having a channel 204 for receiving the hook-shaped portion 198. The hook-shaped portion 198 and the channel 204 cooperate to retain the lid 182 on the container body 188.

Figure 18:
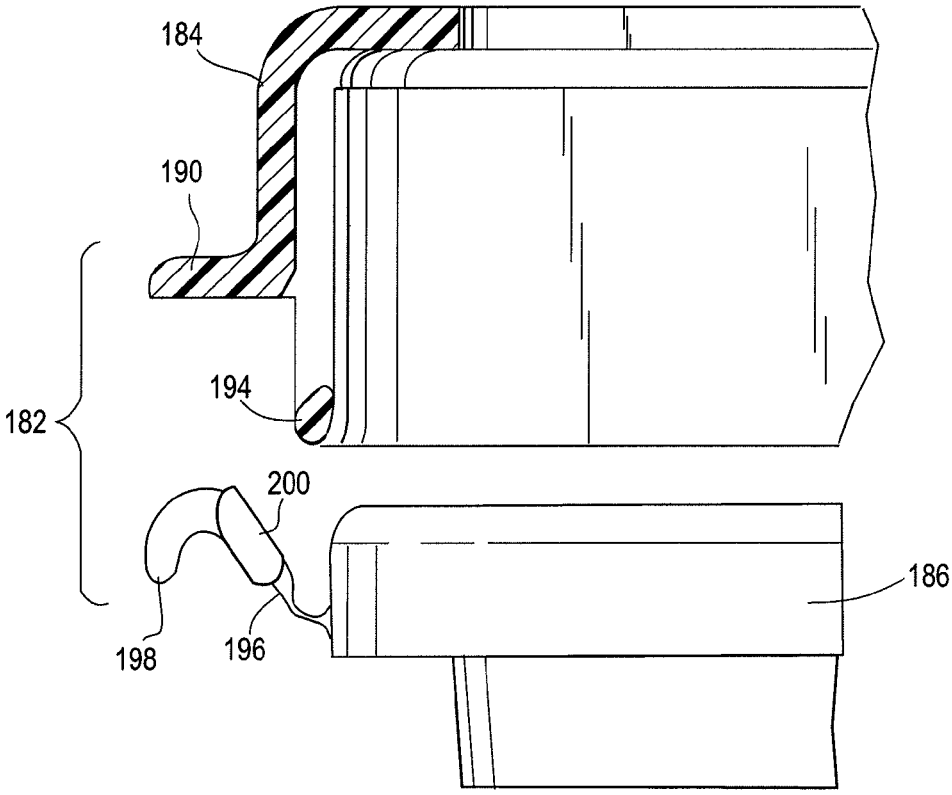
FIG. 18 is a cross-sectional view of a portion of one form of a lid, frame and lid body of the present invention in a disengaged position.
Figure 19:
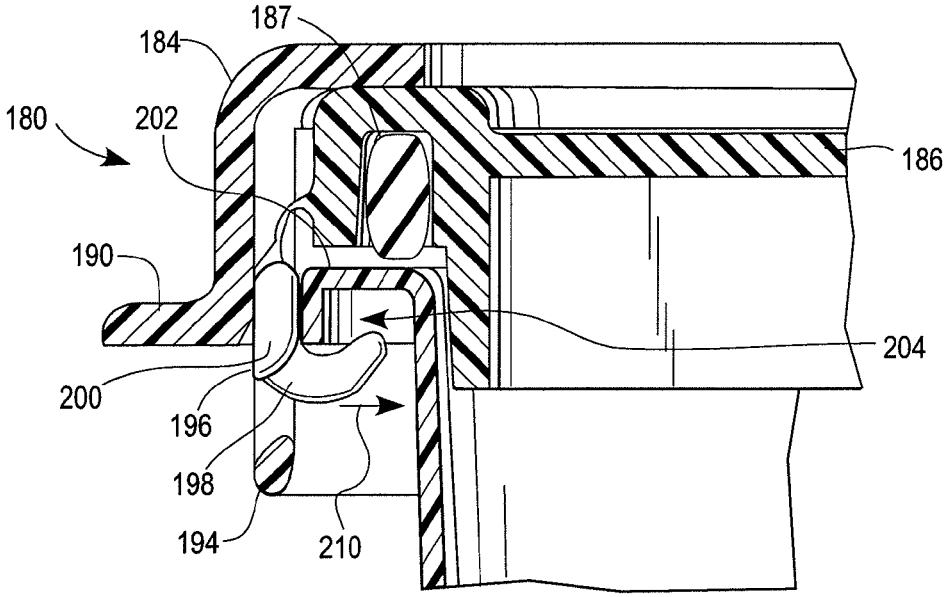
FIG. 19 is a cross-sectional view of a portion of one form of a lid frame, lid body and container body lip of the present invention in an engaged position.

The operation of the container 180 will now be briefly discussed with reference to FIGS. 18-21. Referring to FIG. 18, the container 180 is illustrated in the disengaged position whereby the lid 182 is separated from the container body 188. FIG. 19 illustrates the container 180 moving towards the engaged position. In this regard, the frame 184 cooperates to urge the locking arms 196 inwardly towards the container body 188, as shown by arrow 210. In the engaged position, the hook-shaped portion 198 is positioned in the channel 204 to retain the lid 182 on the container body 188.

Figure 20:
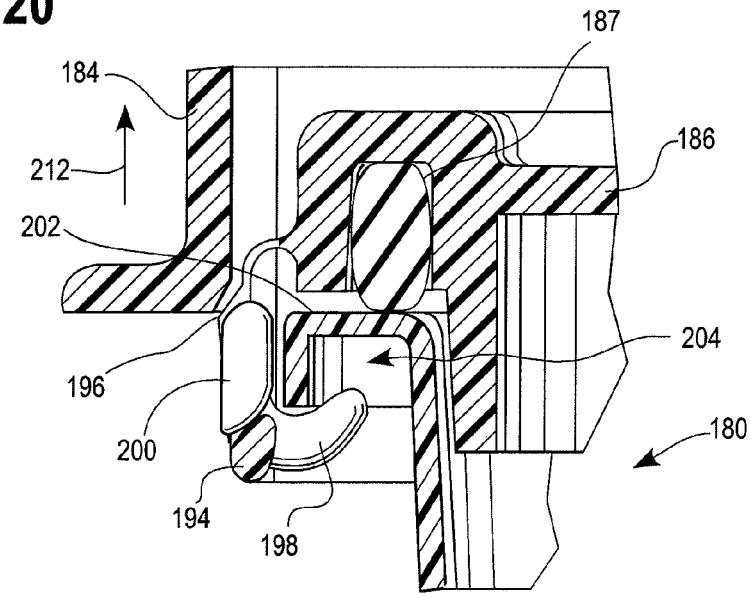
FIG. 20 is a cross-sectional view of a portion of the lid frame, lid body and container body lip of the present invention being moved from the engaged position to the disengaged position.
Figure 21:
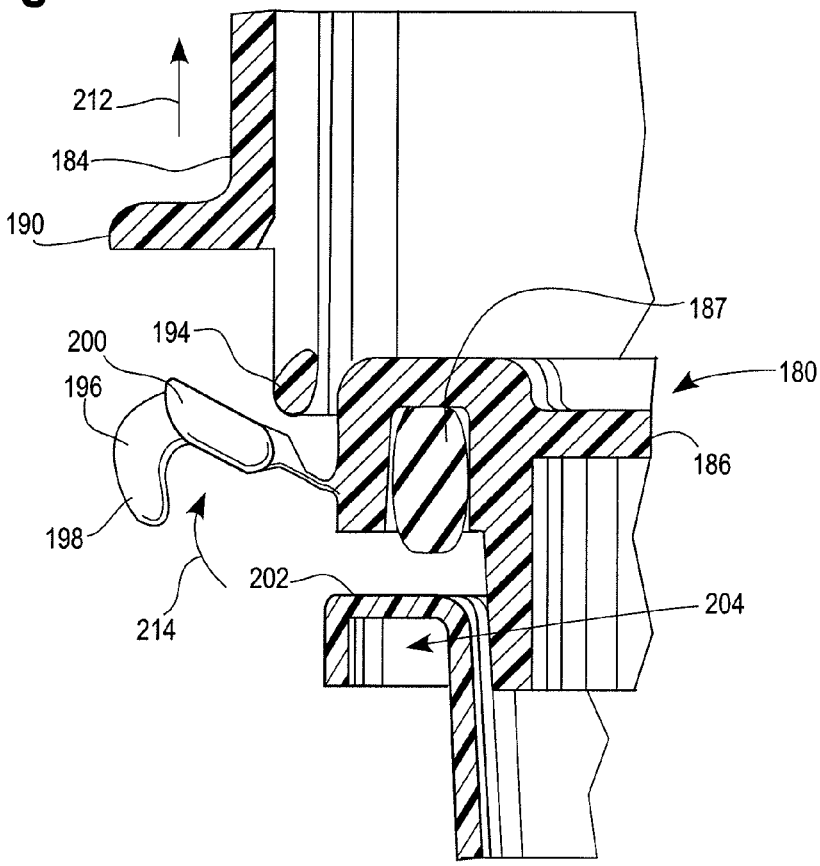
FIG. 21 is a cross-sectional view of a portion of the lid frame, lid body and container body lip of the present invention in the disengaged position.

FIG. 20 illustrates the container 180 moving from the engaged position to the disengaged position. In this regard, the locking arms 196 must be sufficiently disengaged from the container body 188. In many of the previously described containers, by removing the frame, the locking arm may inherently disengage from the container due to the cammed surface. In the present embodiment, the hook-shaped portion 198 will not function in exactly the same manner as the cammed surface, so the frame 184 cooperates with the locking arms 196 to manipulate the locking arms 196. In this regard, when the frame 184 is moved upwardly, as indicated by arrow 212, the pulling arms 194 will contact the disengagement portion 200 and urge the locking arm 196 upwardly and outwardly, as illustrated by arrow 214.

Figure 22:
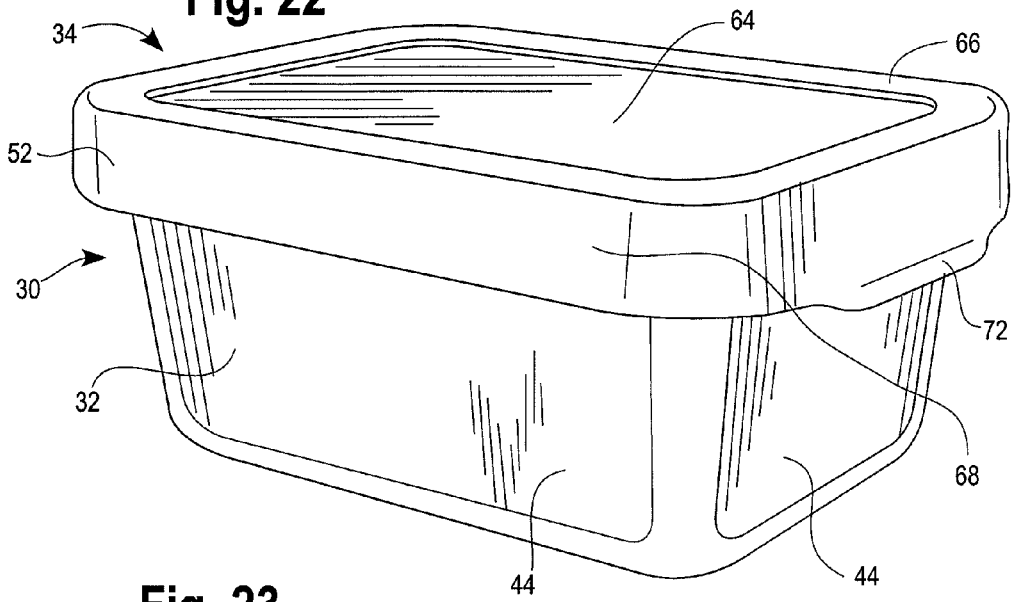
FIG. 22 is a side perspective view of another form of a container of the present invention.
Figure 23:
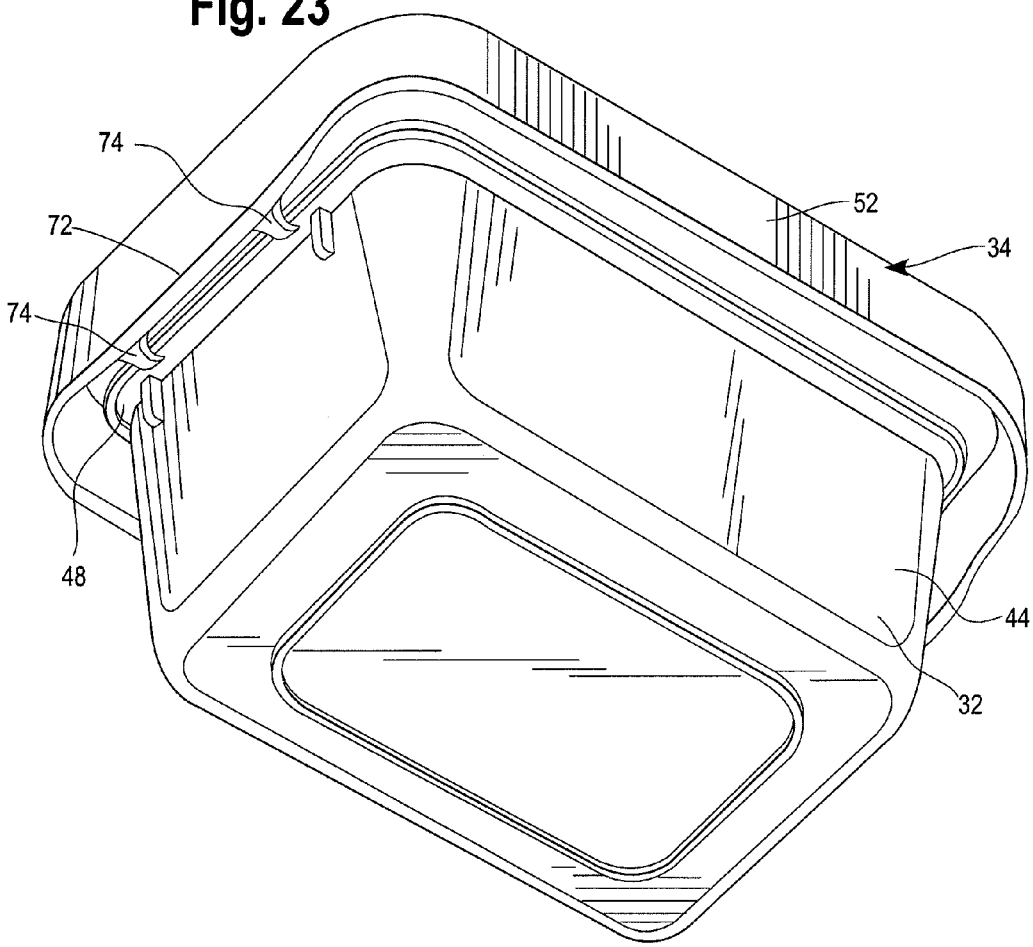
FIG. 23 is a bottom perspective view of the container of FIG. 22.
Figure 24:
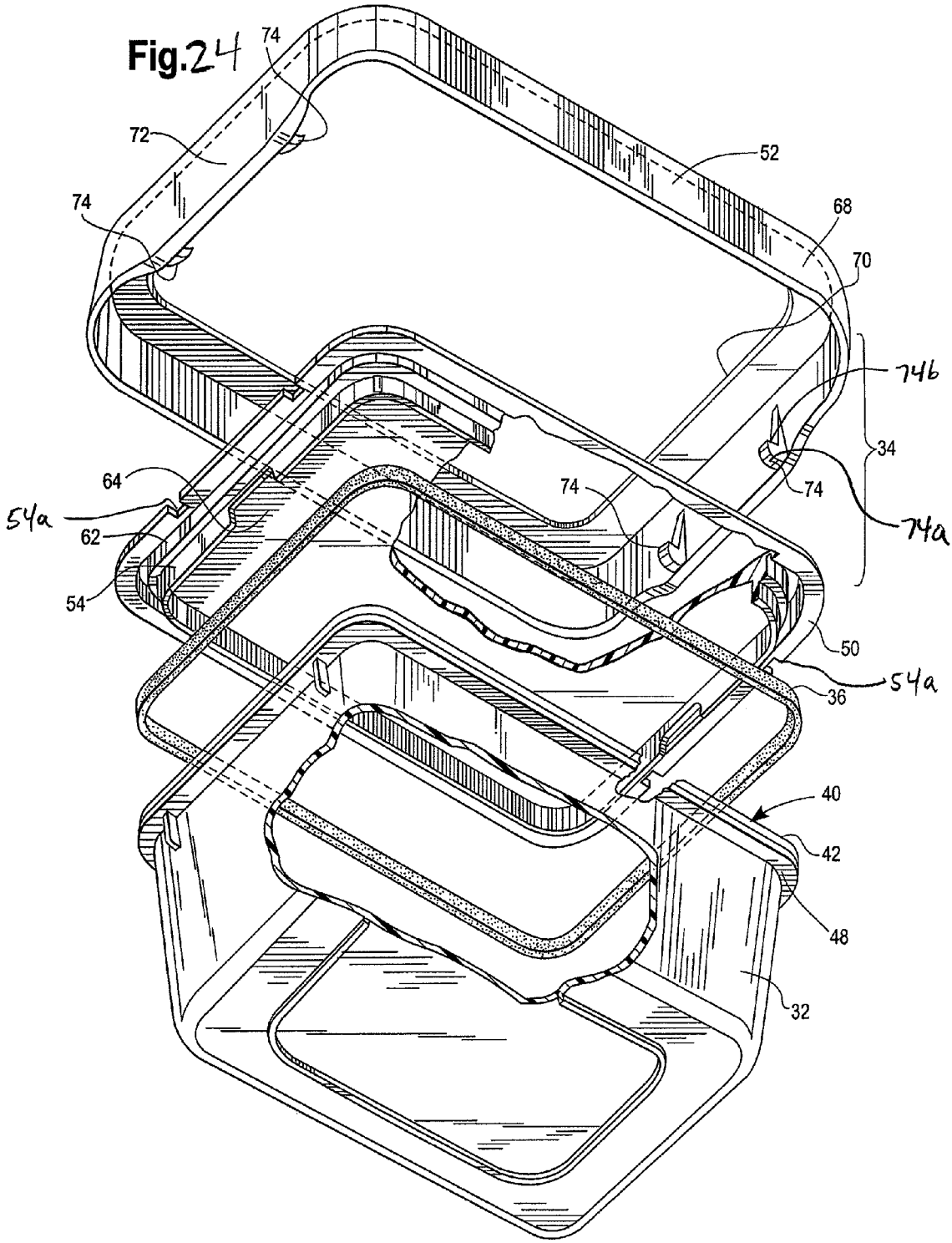
FIG. 24 is a partial cut away, exploded view of the container FIG. 22.

As shown in FIGS. 22-23, the container 30 of the present invention can also be used with only the retaining arms 74 disposed on the frame 52, and without locking arms. The edge of the container body 54 may also include a plurality of notches 54*a* which are sized and shaped to allow the retaining arms 74 to sufficiently pass therethrough in order to allow easy coupling of the body 50 and frame 52 to assemble the lid 34. In an embodiment, two pairs of retaining arms 74 are diametrically disposed on the frame 52 adjacent to release handles 72. It will be appreciated that any number of retaining arms 74 can be used. The retaining arms 74 may also include a sloped cam surface 74*a* which is adapted to abut the edge of lip 42 when the frame 52 and body 50 are assembled and pushed toward the container body 32, causing the retaining arms 74 to be resiliently pushed outwardly until the shoulder

74*b* of the retaining arm 74 engages the engagement portion 48 of the lip 42, causing the retaining arms 74 to be in an engaged position wherein the lid 34 is coupled to the container body 32. The frame 52 is also preferably constructed of a resilient material to allow resilient bending of the frame 52. In an embodiment, the release handles 72 can also be simultaneously pulled outwardly while the lid 34 is coupled to the container body 32 in order to assist the coupling procedure. In an embodiment, the release handles 72, frame 52, container body 54, lip 42 and/or retaining arms 74 are constructed of a resilient material.

To remove the lid 34 from the container body 32, the release handles 72 can be resiliently pulled outwardly or otherwise pivoted in order to allow the retaining arms 74 to be moved to a disengaged position, wherein the shoulder 74*b* of the retaining arms 74 are sufficiently disengaged from the engaging portion 48 of lip 42 in order to allow the lid 34 to removed from the container body 32.

It will be appreciated that since the lid 34 includes separate components frame 52 and body 54, the present invention can be easily disassembled for easy cleaning.

It should be understood by those skilled in the art that the containers described herein may be utilized to provide fluid and/or air tight seals for containers. Furthermore, the containers can provide a positive form of feedback to let the user know that the container is sealed. For example, the frame can positively engage the body and/or frame to ensure that a suitable seal has been secured and may provide an audible or physical "click" type confirmation.

It should be understood that the structures described herein can be manufactured in a variety of different manners from a variety of different materials, as understood by those skilled in the art. For example, the lid and container body can be formed from plastic and other similar materials. Additionally, the structures can be formed by molding and other processes. Finally, it should be understood that the structures can be opaque, translucent and/or transparent as desired. In one form, the container body and the body are transparent to permit the use to see the contents inside the container body.

The matter set forth in the foregoing description and accompanying drawings is offered by way of illustration only and not as a limitation. While particular embodiments have been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

The invention claimed is:

1. A releasably sealable container system comprising:

a container including a container opening defined by a lip and at least one wall, the lip including a sealing portion and an engaging portion;

a lid including a body and a frame, the frame including a top portion, a side portion depending downwardly from the top portion and at least two retaining arms extending inwardly from the side portion, each retaining arm being configured to contact the lip at the engaging portion to retain the lid on the container in an engaging position, the body including a cover portion for covering the container opening when positioned on the container and a skirt depending downwardly from the cover portion, wherein the skirt is sized and positioned on the body to fit inside the container opening, wherein the side portion of the frame at least substantially surrounds the body when the frame is retained on the lip in the engaging position; and a gasket positioned between the lid and the lip, with each retaining arm in the engaging position the gasket contacts the sealing portion of the lip and maintains a substantially liquid tight seal on the container;

wherein the body includes at least two movable locking arms each configured to engage the lip;

wherein the frame is configured to be displaced downwardly to contact each locking arm to move each locking arm inwardly to engage the lip.

2. The container system of claim 1, wherein the frame is separable from the body.

3. The container system of claim 1, wherein the frame is generally rectangular, wherein the at least two retaining arms include first and second retaining arms disposed on a same side of the frame, wherein the frame includes a release handle adjacent the at least two retaining arms, wherein the release handle is used to manipulate the at least two retaining arms, wherein the release handle is configured to be pulled outwardly, away from the container, to pull the retaining arm away from the container to disengage the retaining arm to allow for removal of the lid.

4. The container system of claim 3, wherein the release handle is disposed between the first retaining arm and the second retaining arm.

5. The container system of claim 4, wherein the release handle is formed by the side portion of the frame.

6. The container system of claim 1, wherein the frame is generally polygonal, wherein the at least two retaining arms includes first and second retaining arms disposed on a first side of the frame and third and fourth retaining arms disposed on a second side, which is opposite the first side, of the frame, wherein the frame includes a first release handle disposed between the first and second retaining arms and a second release handle disposed between the third and fourth retaining arms.

7. The container system of claim 1, wherein the skirt is a wall offset from a peripheral edge of the body generally following and parallel to the peripheral edge.

8. The container system of claim 1, wherein the lip protrudes outwardly from the wall and the sealing portion is a top of the lip and the engaging portion is a lower portion of the lip.

9. The container system of claim 1, wherein the at least two retaining arms includes first and second retaining arms on opposite sides of the frame and the at least two locking arms includes first and second locking arms on opposite sides of the body.

10. The container system of claim 1, wherein at least one of the at least two retaining arms contacts the lip on a first side of the container that is generally perpendicular to a second side of the container, wherein at least one of the at least two locking arms engages the lip on the second side of the container.

11. The container system of claim 10, wherein the first side of the container is adjacent the second side of the container.

* * * * *